US010233788B1

(12) United States Patent
Tice

(10) Patent No.: US 10,233,788 B1
(45) Date of Patent: Mar. 19, 2019

(54) METHOD AND APPARATUS UTILIZING THERMALLY CONDUCTIVE PUMPS FOR CONVERSION OF THERMAL ENERGY TO MECHANICAL ENERGY

(71) Applicant: Neil Tice, Hillsboro, OR (US)

(72) Inventor: Neil Tice, Hillsboro, OR (US)

( * ) Notice: Subject to any disclaimer, the term of this patent is extended or adjusted under 35 U.S.C. 154(b) by 292 days.

(21) Appl. No.: 15/007,428

(22) Filed: Jan. 27, 2016

Related U.S. Application Data

(63) Continuation-in-part of application No. 13/860,485, filed on Apr. 10, 2013.

(60) Provisional application No. 61/622,356, filed on Apr. 10, 2012, provisional application No. 61/622,347, filed on Apr. 10, 2012.

(51) Int. Cl.
*F01K 21/02* (2006.01)
*F02G 1/02* (2006.01)

(52) U.S. Cl.
CPC ..... *F01K 21/02* (2013.01); *F02G 1/02* (2013.01)

(58) Field of Classification Search
CPC .... F01B 1/00; F01B 29/00; F02G 1/04; F02G 1/053; F25B 1/00
See application file for complete search history.

(56) References Cited

U.S. PATENT DOCUMENTS 2,373,130 A 4/1945 Malone
2,959,017 A * 11/1960 Gilman ..... F25B 21/02 62/3.2
3,173,244 A 3/1965 Schutmaat
3,500,634 A 3/1970 Waseleski, Jr. et al.
3,754,151 A 8/1973 Clark
3,989,417 A 11/1976 Neidigh
4,006,594 A 2/1977 Horton
4,075,847 A 2/1978 Ray
4,086,769 A 5/1978 Smith
4,124,177 A * 11/1978 Timmerman ..... F24D 11/0235 237/2 B
4,178,987 A * 12/1979 Bowman ..... F25B 15/09 165/104.12
4,197,709 A 4/1980 Hochstein
(Continued)

FOREIGN PATENT DOCUMENTS

WO WO 0187060 A1 11/2001

*Primary Examiner* — Mark Laurenzi
*Assistant Examiner* — Shafiq Mian
(74) *Attorney, Agent, or Firm* — Timothy E. Siegel Patent Law, PLLC; Timothy E. Siegel

(57) ABSTRACT

A heat-driven engine having a first, thermally conductive, pump to which a working medium is admitted and within which the working medium subsequently absorbs its latent heat while undergoing a phase change from low to high enthalpy phase before being expelled from the first pump. Also, a restrictive cooling element accepts the working medium in its high enthalpy phase and allows it to release its latent heat and undergo a phase change from a liquid to a low enthalpy phase. A first and a second passage, through which the working medium traverses, connects the first pump and the cooling element. The second passage incorporates a thermally conductive element, placing the working medium in thermal contact with a heat source or sink. Also, a heat pump is in thermal contact with the first pump and the cooling element. Finally, a power transmission element links the first pump to the heat pump.

26 Claims, 8 Drawing Sheets

(56) References Cited

U.S. PATENT DOCUMENTS 4,307,541 A 12/1981 Farmer et al.
4,307,571 A 12/1981 Jackson
4,325,217 A 4/1982 Golestaneh
4,330,992 A 5/1982 Senft
4,598,550 A 7/1986 Abbott
4,603,593 A 8/1986 Clegg
4,691,518 A 9/1987 Banks
4,736,587 A 4/1988 Suzuki
4,777,805 A * 10/1988 Hashizume ..... F25B 1/00 62/114
5,253,482 A * 10/1993 Murway ..... F25B 5/02 62/175
5,430,333 A 7/1995 Binford et al.
5,442,914 A 8/1995 Otsuka
6,226,992 B1 5/2001 Kutlucinar
6,374,607 B1 4/2002 Takabu
6,647,725 B1 11/2003 Letovsky
6,786,045 B2 9/2004 Letovsky
6,796,124 B2 9/2004 Kutlucinar
6,804,224 B1 10/2004 Schuster et al.
6,872,433 B2 3/2005 Seward et al.
7,093,458 B2 * 8/2006 Hu ..... B64D 13/00 62/238.6
7,399,112 B2 7/2008 Haughton
7,775,042 B1 8/2010 Tice
8,522,545 B2 9/2013 Tice
8,935,921 B2 1/2015 Tice
2001/0017335 A1 8/2001 Kutlucinar
2002/0046565 A1 4/2002 Singh
2002/0187020 A1 12/2002 Julien
2003/0000213 A1 * 1/2003 Christensen ..... F01K 25/08 60/670
2003/0226359 A1 12/2003 Letovsky
2005/0059906 A1 * 3/2005 Tsaur ..... A61B 10/0045 600/573
2005/0194313 A1 * 9/2005 Chordia ..... B01D 11/0203 210/634
2005/0205125 A1 9/2005 Nersessian et al.
2005/0210874 A1 9/2005 Browne et al.
2006/0059906 A1 3/2006 Pierce
2006/0144048 A1 7/2006 Schulz
2007/0200656 A1 8/2007 Walak
2008/0303375 A1 12/2008 Carver
2008/0307813 A1 * 12/2008 Lifson ..... F25B 49/022 62/228.4
2009/0315489 A1 12/2009 Karim et al.
2010/0043467 A1 * 2/2010 Kawano ..... F25B 13/00 62/129
2011/0088397 A1 * 4/2011 Mori ..... F01K 23/065 60/661
2011/0309635 A1 * 12/2011 Sardo ..... F01K 25/08 290/1 A
2013/0074488 A1 * 3/2013 McBride ..... F01B 23/00 60/508
2014/0013786 A1 * 1/2014 Kanamaru ..... F22B 3/00 62/238.7

* cited by examiner

METHOD AND APPARATUS UTILIZING THERMALLY CONDUCTIVE PUMPS FOR CONVERSION OF THERMAL ENERGY TO MECHANICAL ENERGY

RELATED APPLICATIONS

This application is a continuation-in-part of application Ser. No. 13/860,485 filed Apr. 10, 2013, which claims priority from application Ser. No. 61/622,356, filed on Apr. 10, 2012 and application Ser. No. 61/622,347, filed on Apr. 10, 2012 which are incorporated by reference as if fully set forth herein.

BACKGROUND

With the availability of heat engines utilizing a fully regenerative phase-change thermodynamic cycle, it is possible to convert the thermal energy contained in a uniform-temperature environment directly to mechanical or electrical energy (see PCT/US11/41289 Thermal Engine Capable of Utilizing Low-Temperature Sources of Heat, inventor Neil Tice, and U.S. Pat. No. 7,816,601 Device and method for converting thermal energy into electrical energy, inventor David Reginald Carver) without the need for an additional reservoir of a cooler temperature in which to dump waste heat. The key component of this type of engine is a working medium consisting of a material which undergoes a first phase change while absorbing latent heat of transformation, then undergoes a return phase change to complete the cycle.

Any phase change from one state to another, including from one solid state to another solid state, for example, can be used to convert heat to another form of energy. Many of the potential phase transitions involve a change from one fluid state to another fluid state. Fluid in this sense means the ability to flow, and is not restricted to liquids. Examples may include liquid to vapor, liquid to liquid, and vapor to vapor. Additional possibilities may involve compound mediums, such as a liquid with solid particles blended into a slurry, with one or both undergoing a phase change which results in a change in volume or pressure. Any compound which undergoes a change in volume or pressure as a result of one or more phase changes, and remains fluid in all relevant states, is a candidate for use in the present invention.

One inefficiency experienced in heat engines, in general, is that in the transition from the high-enthalpy gas to the low-enthalpy liquid state and the return transition from gas to liquid state (in, for example, an engine driven by the liquid to gas transition), either the work performed by the transition from low enthalpy to high enthalpy is not captured, or the latent heat energy released by the transition from high enthalpy to low enthalpy is wasted. Efficiencies may be gained by utilizing the latent heat expressed during the high- to low-enthalpy phase change and capturing the work output of the low- to high-enthalpy phase change.

INCORPORATIONS

Patent application PCT/US11/41289, submitted Jun. 21, 2011, is hereby incorporated by reference as if fully set forth herein.

SUMMARY

Theory of Operation

The key component of a fully-regenerative heat engine cycle is the use of a working medium which undergoes a full cycle of phase changes during the heat engine cycle, returning to its original state at the end of the cycle. The working medium must be a material which, during the course of its phase change cycle, converts a portion of its latent heat of transformation from thermal energy to mechanical energy through a change in pressure, volume, or both. During the cycle, the working medium undergoes a phase change from a low-enthalpy state to a high-enthalpy state while absorbing its latent heat of transformation, and subsequently undergoes a phase change from a high-enthalpy state back to a low-enthalpy state. During the latter phase change it expels its latent heat of transformation, less the portion which of the latent thermal energy which was converted to mechanical energy.

In order to convert the latent heat from thermal to mechanical energy, the working medium must act on a mechanical device simultaneously with its phase change and consequent change in pressure, volume, or simultaneous change in pressure and volume.

If the mechanical work done during the phase change is non-zero, the internal energy (the latent heat) of the working medium must be reduced by an amount greater than or equal to the mechanical work done during the phase change, pursuant to the First Law of Thermodynamics.

Any implementation of the fully-regenerative engine using a working medium that undergoes liquid-vapor phase change requires that the fluid medium undergo its phase change within a defined, albeit changing, volume. The volume must vary in a defined relationship to the thermal energy absorbed by the fluid medium, such that the product of the partial pressure and the molar volume of the vaporous working medium remains constant as the working medium vaporizes or condenses. If the volume varies according to this principle, then the work done on the variable-volume chamber (defined as $W=P\Delta V$) must be a conversion of the latent heat to mechanical energy, rather than a conversion of sensible heat to mechanical energy as in the Rankine cycle or other similar engines.

The present invention offers a practical method of capturing the mechanical work done by a fluid medium which undergoes a liquid to vapor, liquid to liquid, or vapor to vapor phase change. By capturing energy at each phase transition, the preferred embodiment captures a greater proportion of available energy than currently available systems.

DETAILED DESCRIPTION OF THE PREFERRED EMBODIMENTS

Types of Pumps and their Operation

The controlled-volume characteristic required of a mechanism for converting the latent heat of a fluid medium to mechanical energy (or the reverse, converting mechanical energy to latent heat) can be achieved by allowing the fluid medium to absorb latent heat as it passes through a pump. For the purposes of the present invention, the mechanism referred to as a pump may operate as either a pump or an engine, either imparting energy to a fluid or converting the energy of a fluid to another form of energy.

The pump mechanism may be any type of pump, so long as the correct relationship between volume, pressure, and absorption or release of latent heat may be maintained. This includes the positive-displacement type of pumps (for example reciprocating pumps, gear pumps, screw pumps, or gerotors) as well as dynamic pumps such as centrifugal pumps or impeller turbines. For ease of explanation, this document will primarily refer to positive-displacement pumps as the preferred embodiments.

Behavior of Liquid-Vapor Phase Change in a Variable-Volume Chamber

The behavior of a working medium undergoing a liquid to vapor phase change while being harnessed to do mechanical work will be used as a representative case for a regenerative engine utilizing a fluid working medium. The same or similar methods may be utilized with any phase change which goes from one fluid state to another fluid state, causing a change in volume while doing so.

The phase change and subsequent expansion of a liquid into a vapor, while confined within the chamber of a positive displacement pump, shares some characteristics with a type of boiling-liquid expanding-vapor explosion (BLEVE). The volume, though it may change rapidly, remains controlled rather than changing in a violent and uncontrolled manner.

The pertinent type of BLEVE is the result of a situation in which a pressure vessel contains a nonflammable liquid-vapor mixture. In this case, the entire liquid-vapor mass is held at a temperature above its boiling point temperature at ambient pressure, due to elevated pressure inside the pressure vessel. The trouble starts when the pressure vessel is breached. Even a small breach can lower the internal pressure enough to cause the liquid to boil rapidly, generating large amounts of vapor at high pressures. The high overpressure wave causes a further breach of the pressure vessel, boiling the remaining liquid and releasing large amounts of mechanical work—potentially destroying the pressure vessel.

Like the BLEVE, the controlled conversion of the latent heat of vaporization to mechanical work relies on the ability of a boiling liquid to increase the volume of vapor at the same time as pressure is rising. Unlike the BLEVE, the liquid temperature is controlled to provide a predictable rate of vapor production, and the chamber expands so as to accommodate the increased vapor volume.

Figure 1:
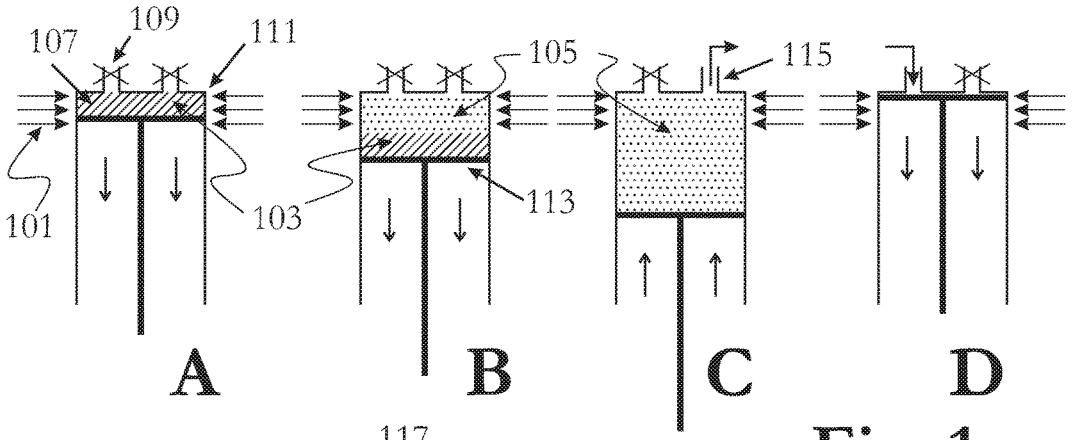
FIG. 1 is a schematic of piston position during liquid-vapor phase change, in a heat engine assembly according to the present invention.

The cycle starts as a liquid or a liquid-vapor combination is introduced to a variable-volume chamber, such as a cylinder containing a movable piston, as shown in FIG. 1. At the outset, the liquid or liquid-vapor combination 103 completely fills the chamber 107, which is near its minimum-volume configuration, and the intake through which the liquid was introduced 109 is then closed off or occluded as shown in FIG. 1A. A portion of, or all of, the chamber walls must be thermally conductive and thermally connected to a source of heat 101 at a high enough temperature that the temperature of the chamber walls will remain above the temperature of the liquid throughout the liquid to vapor phase change.

Figure 2:
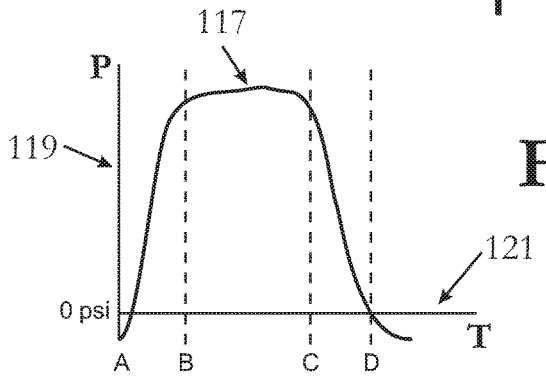
FIG. 2 is a graph of pump pressure versus time, during liquid-vapor phase change in the heat engine assembly of FIG. 1, with letters A, B, C and D corresponding to the piston positions shown in FIG. 1, at A, B, C, and D respectively.

The liquid absorbs heat from the chamber walls 111, such that it begins to boil. The resulting production of vapor 105 increases the chamber pressure until it reaches a pressure sufficient to move the piston 113. As the piston begins to move, causing the chamber to expand (FIG. 1B), the chamber pressure will stabilize at a value which balances the rate of heat absorption of the liquid (and consequent vapor production) with the speed of the chamber's expansion. The vapor will exert a roughly constant pressure as the chamber expands, thus doing work on the piston. Cylinder pressure versus time will approximate the curve 117 shown in FIG. 2, which is a plot of cylinder pressure 119 vs. time 121 which has points in time A, B, C, D corresponding to FIG. 1.A through FIG. 1.D, respectively.

At the end of the cycle all the liquid will ideally have been converted to vapor and the piston will be in its maximum-volume configuration (FIG. 1C). The vapor can then be expelled from the chamber through an outlet 115 as the piston returns to the minimum-volume position in preparation for another cycle (FIG. 1.D).

Behavior of Vapor to Liquid Phase Change in Reciprocating Piston System

Figure 3:
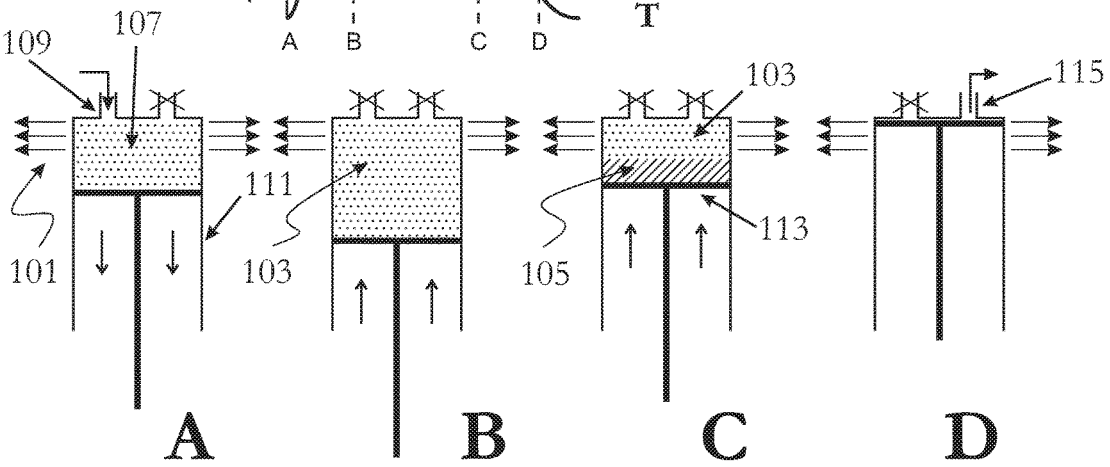
FIG. 3 is a schematic of piston position during vapor-liquid phase, in a heat engine assembly according to an alternative preferred embodiment of the present invention.

A similar process may be made to occur when vapor undergoes a vapor to liquid phase change, as shown in FIG. 3. When used in the manner shown in FIG. 3, the pump shown may be considered to be a form of a restrictive cooling element. In this case, the vapor 103 is introduced to a chamber 107 of variable volume, such as a cylinder with a piston 113. In this case the piston will draw in a volume of vapor through an intake 109 at a relatively constant pressure as it moves from its minimum-volume position to its maximum-volume position (FIG. 3A). The chamber walls 111 must be held at a temperature lower than that of the vapor throughout the phase change cycle, and cooled through heat loss 101 to a heat sink at a rate sufficient to maintain the low temperature.

Figure 4:
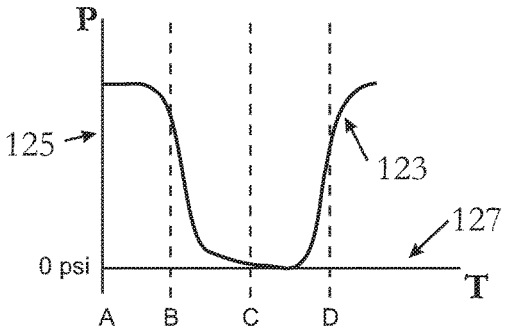
FIG. 4 is a diagram of pump pressure during vapor-liquid phase change for the heat engine assembly of FIG. 3, with letters A, B, C and D corresponding to the piston positions shown in FIG. 3, at A, B, C, and D respectively.

Once the intake 109 is closed off or occluded (FIG. 3.B), the vapor will condense to liquid 105 as its heat is conducted away through the chamber walls 111. The reduction in volume caused by the reduction in the quantity of vapor 103 will exert a force on the piston, causing it to move inward and the chamber volume to decrease (FIG. 3.C). The chamber pressure will stabilize at a pressure which balances the rate of change of the chamber volume with the rate at which the vapor's latent heat is lost to the chamber walls. The approximate pressure curve 123 is shown in FIG. 4, a plot of pressure 125 vs. time 127 with points in time A, B, C, D which correspond to FIG. 3.A through FIG. 3.D.

At the end of the cycle, ideally all of the vapor will have condensed to liquid and the piston will be nearly at its minimum-volume condition. The liquid can then be expelled from the chamber through an outlet 115 and the cycle can begin again (FIG. 3.D).

Single-Acting or Dual-Acting Pistons

The power density of the cylinder plus reciprocating piston design can be improved if a piston design known to those skilled in the arts as a "double-acting piston" is used instead of a single-acting piston. The double-acting piston uses the piston to divide the cylinder into two chambers, one at each end, with a set of intake and exhaust valves for each chamber. The valves are actuated such that the two chambers operate on identical but opposed cycles. Thus, when one chamber is at its maximum volume, the other is at its minimum volume, and vice-versa.

An advantage of the double-acting piston when used for the fully-regenerative cycle is that one chamber will be at its maximum pressure while the other is at its minimum pressure. This will increase the net work done on the piston over a single-acting piston where the non-chamber side of the piston faces a constant pressure.

Rotating Positive Displacement Pumps

While a system consisting of a cylinder plus a piston is easily understood, it may not be the most practical arrangement for a fully-regenerative engine. A cylinder plus piston is also known as a "positive displacement pump", and there are many other types of positive displacement pumps, any of which may be employed in a fully regenerative engine. Rotating positive displacement pumps can offer a more consistent flow with fewer moving parts, greater efficiency, and higher power density. Possible choices for the pumps in a fully-regenerative engine are gear pumps, roots-type pumps, or gerotors.

Figure 5:
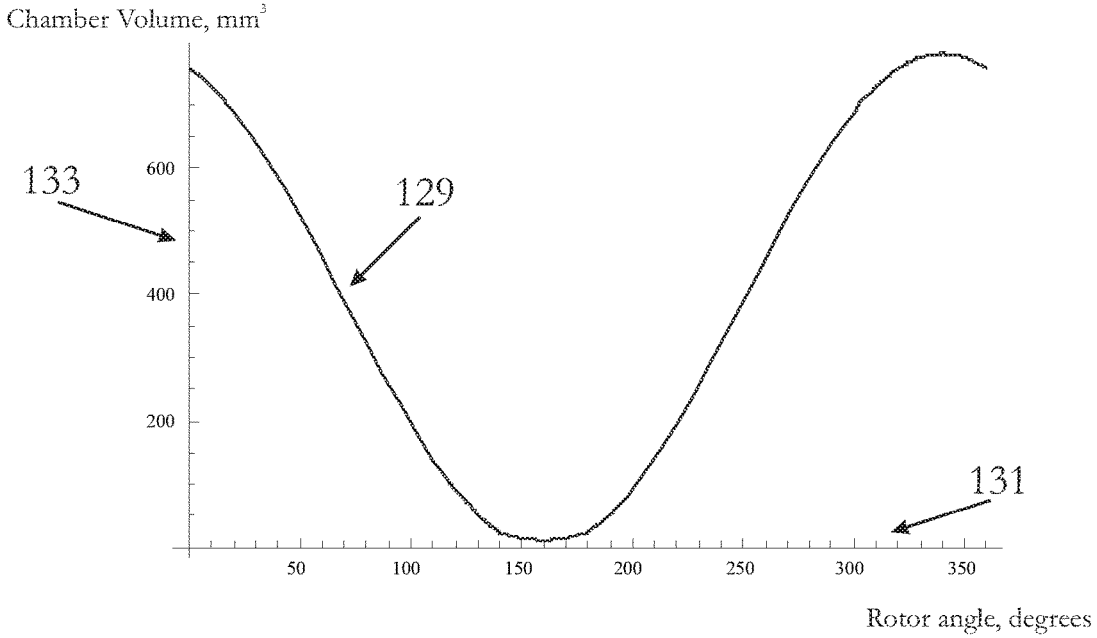
FIG. 5 is a diagram of gerotor volume with respect to rotor position for an alternative embodiment of the heat engine of the present invention, utilizing the gerotor of FIG. 6.
Figure 6:
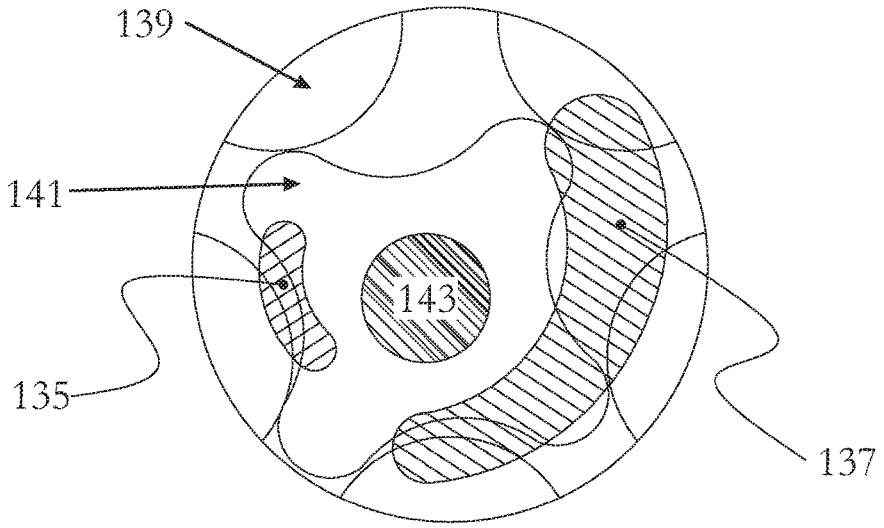
FIG. 6 is a diagram of a gerotor, which is a part of an alternative preferred embodiment of the present invention, showing intake and outlet ports.

A representative case of a design is a thermally conductive pump utilizing a gerotor. A gerotor consists of an inner and outer rotor. The inner rotor has N teeth (generally with a trochoidal shape), and the outer rotor has N+1 teeth (made up of circular arcs which mesh with the inner rotor teeth). The inner rotor is placed off-center from the outer rotor such that the rotors partition the volume between them into N chambers. FIG. 5 is a plot of the variation in chamber volume for a representative gerotor design 129, with the rotor angle in degrees on the horizontal axis 131 and the chamber volume in cubic millimeters on the vertical axis 133. As the rotors rotate, the chamber volumes change; first increasing in volume, then decreasing, as in the plot of chamber volume 129. FIG. 6 is a cross-section of a representative gerotor design, showing the intake to the gerotor 135 in the portion of the rotor cycle wherein the chamber volume is increasing. The chamber is formed in the space between the outer rotor 139 and the inner rotor 141 as the inner rotor rotates around an off-center axle 143 and drives the outer rotor. While the chamber is exposed to the intake, fluid is drawn into the chamber. The rotors then rotate such that the inlet is cut off from the chamber.

The outlet of the gerotor 137 is in the portion of the rotor wherein the chamber volume is decreasing. When the rotors move such that the chamber is exposed to the outlet, the fluid is forced out of the chamber through the outlet. At the end of the rotor cycle, the chamber volume is close to zero, the outlet is occluded, and the cycle can begin again.

Multiple-Ganged Pumps

Although the simplest design case is for each of the pump functions to be carried out within a single pump chamber, it is desirable in some instances to utilize multiple pumps in parallel, with inputs and outputs all connected to the same fluid medium passages and all connected to a power transmission element (such as a drive shaft, or electric motor/generators connected by appropriate power routing devices) such that they work in concert. Multiple pumps ganged together in this manner may result in reduced fluid flow rate or torque pulsations as compared to a single pump chamber.

Multiple-Ganged Engines

Another design that has some advantages is to use multiple-ganged engines, with pairs of pumps connected by fluid medium passages, and all the pairs of pumps connected by a power transmission element. The paired pumps may have reduced flow resistance through the fluid medium passages while still having lower torque ripple due to the multiple pairs of pumps.

Discussion of Complete Heat Engine Assemblies

Figure 7:
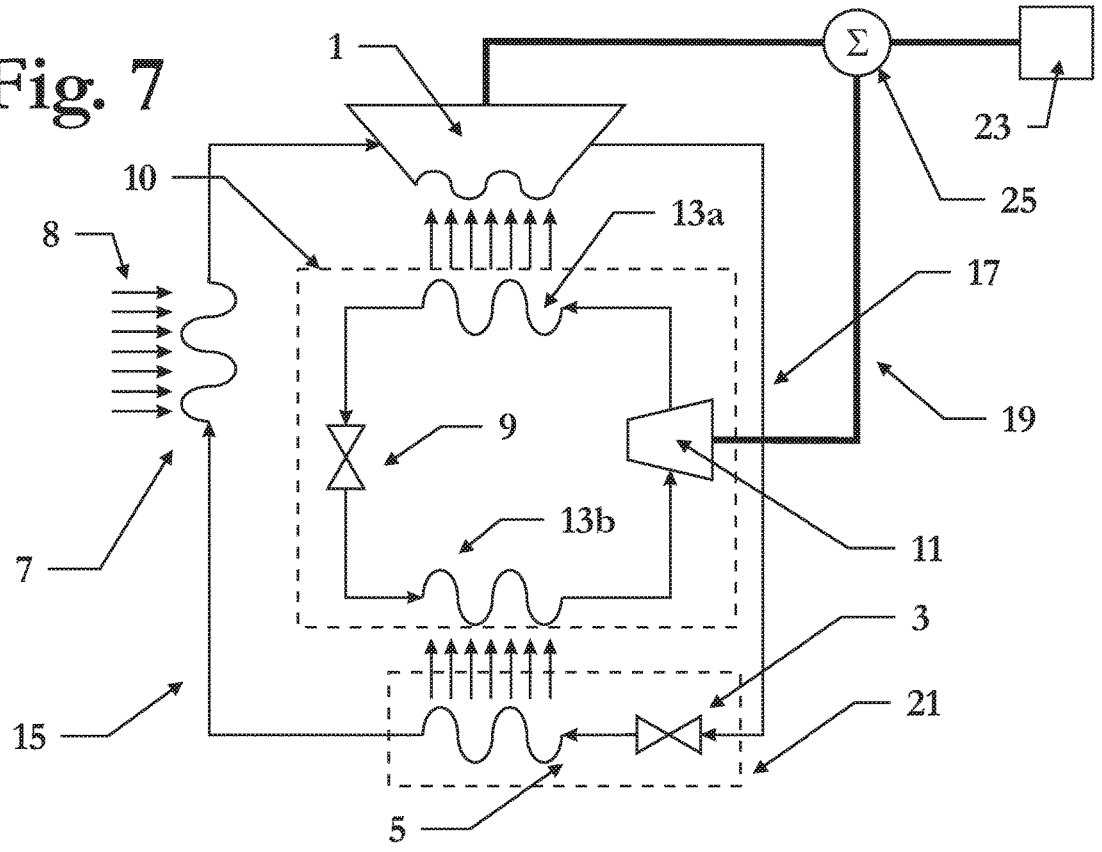
FIG. 7 is a diagram of a single-pump heat engine assembly (with a vapor compression heat pump), according to a preferred embodiment of the present invention.

FIG. 7 Diagram of Single-Pump System (with Vapor Compression Heat Pump)

Referring to FIG. 7, a preferred embodiment of a heat engine includes a heat pump 10. In one set of preferred embodiments, the working medium used in the fluid circuit that includes a thermally conductive pump 1, is a different substance than the fluid medium used in heat pump 10. In a preferred embodiment the fluid of heat pump 10 is a class 1 refrigerant, a class of substances well known to skilled persons.

The thermally conductive phase-change pump 1 incorporates a chamber that brings the working medium directly or indirectly into thermal contact with a heat exchanger 13*a*, allowing the working medium to undergo its liquid-to-vapor phase change and transmitting the energy of that change to a power transmission element 19. The working medium exits the phase-change pump 1 via a passage 17 and proceeds to a restrictive cooling element 21 composed of expansion valve 3 and a "restrictive cooling element," acting as a heat exchanger 5 and subsequently to a passage 15. A restrictive cooling element is one in which the working medium flow is restricted to the level at which the phase change to the low enthalpy state is completed for all fluid that passes through. Expansion valve 3 allows the working medium into heat exchanger 5 at a rate to maintain working medium within heat exchanger 5 at a partial pressure which allows it to release its residual latent heat which is conveyed from heat exchanger 5 to heat exchanger 13*b*, as the working medium transitions from a high to a low enthalpy state.

Heat exchanger 13*b* imparts the residual latent heat to the heat pump medium, which then passes through an expansion valve 9 heat exchanger 13*a* and compressor 11, to complete a vapor-compression heat pump cycle. Compressor 11 draws its power from power transmission element 19. The heat pump cycle has the effect of removing the remaining latent heat from the working medium at heat exchanger 5 and supplying it to the working medium in thermally conductive pump 1.

The working medium exits heat exchanger 5 in its liquid state with substantially lowered or zero vapor content and is conveyed via passage 15 to heat exchanger 7, where it absorbs heat from an external source 8. The working medium then is conveyed to thermally conductive pump 1 to begin the cycle again. In one preferred embodiment, external heat source 8 is also used to heat thermally conductive pump 1, in addition to heat exchanger 13*a*.

Power-routing element 25 allows an external power source or sink 23 to either drive or be driven by power transmission element 19.

Heat pump 10 pumps a greater quantity of heat energy than the quantity of mechanical energy that is used to drive the compressor 11. Less latent heat is extracted from the working medium by heat exchanger 5 than is absorbed by the working medium in thermally conductive pump 1, because some of the latent heat is converted to work by pump 1. Therefore, in order to supply all of the thermal energy required for the working medium to complete its phase change within thermally conductive pump 1, the working medium must exit heat exchanger 5 at a lower temperature than it enters thermally conductive pump 1. But heat exchanger 7, driven by external source 8, warms up the working medium so that it is approaching the temperature at which it changes phase when it reaches thermally conductive pump 1, thereby permitting heat engine 10 to supply all of the latent heat required to cause the working medium to change phase within thermally conductive pump 1.

Figure 8:
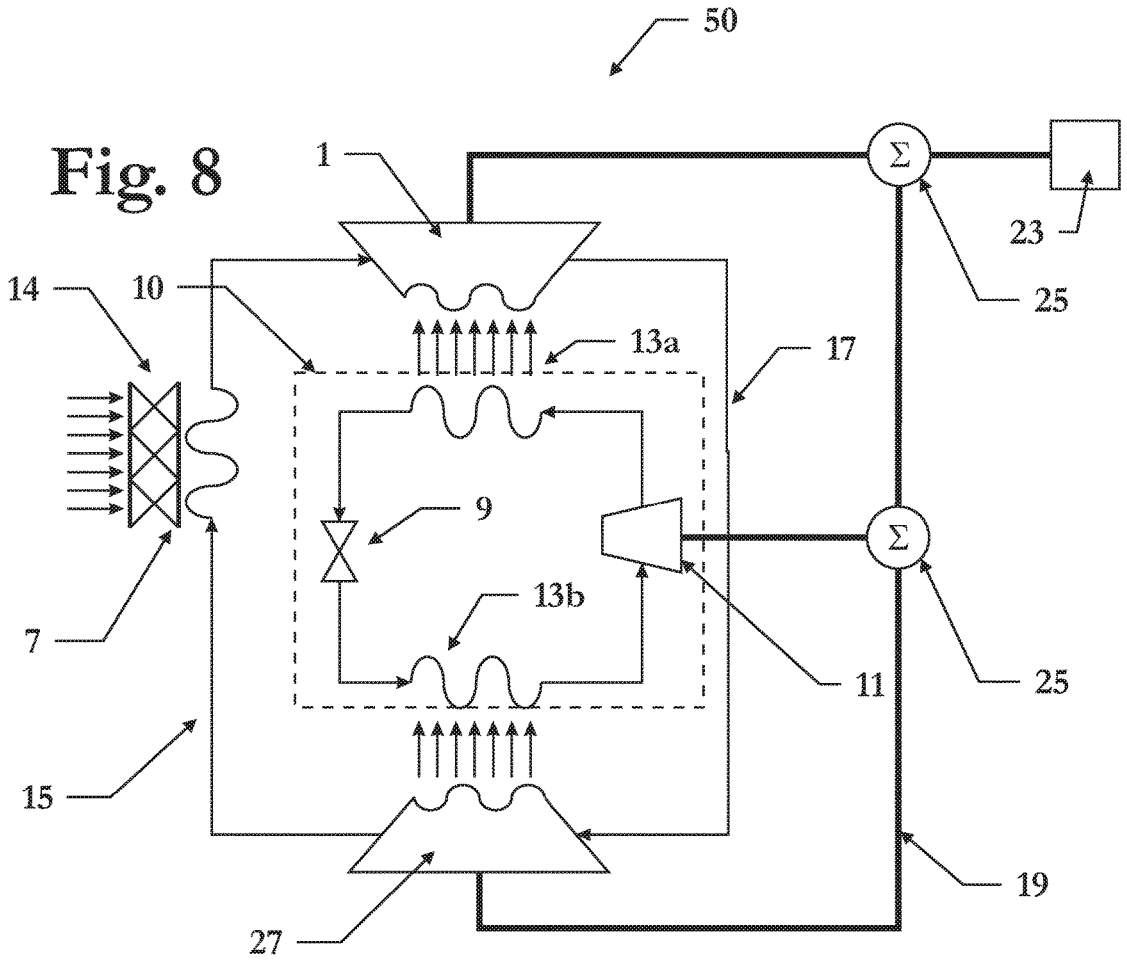
FIG. 8 is a diagram of a two-pump heat engine assembly, according to a alternative preferred embodiment of the present invention.

FIG. 8 Diagram of Two-Pump System

FIG. 8 shows a heat engine 50 that, similar to heat engine 4, includes a heat pump 10.

The thermally conductive pump 1 incorporates a chamber that brings the working medium directly or indirectly into thermal contact with a heat exchanger 13*a*, allowing the working medium to undergo its liquid-to-vapor phase change and transmitting the energy of that change to a power transmission element 19. The working medium exits the phase-change pump 1 via a passage 17 and proceeds to a second thermally conductive pump 27 and subsequently to passage 15. Pump 27 allows the working medium to release its residual latent heat which is conveyed to heat exchanger 13*b*, and also shares power with power transmission element 19 via a power summation element 25.

Heat exchanger 13*b* imparts the residual latent heat to the heat pump medium, which then passes through an expansion valve 9 heat exchanger 13*a* and compressor 11, to complete a vapor-compression heat pump cycle. Compressor 11 draws its power from power transmission element 19. The heat pump cycle has the effect of removing the remaining latent heat from the working medium at heat exchanger 5 (FIG. 7) and supplying it to the working medium in thermally conductive pump 1.

The working medium exits pump 27 in its liquid state with substantially lowered or zero vapor content and is conveyed via passage 15 to heat exchanger 7, where it absorbs heat from an external source. The rate of heat absorption is moderated by a layer of conductive material 14 which has reduced thermal conductivity compared to the heat exchanger, such as a heat spreader composed of steel or cast iron. The purpose of this layer is to reduce the heat flow into exchanger 7, and allow the use of a heat source having a high temperature relative to the desired temperature of the fluid as it leaves exchanger 7. The working medium then is conveyed to thermally conductive pump 1 to begin the cycle again.

A power summation element 25 allows an external power source or sink 23 to either drive or be driven by power transmission element 19.

Figure 9:
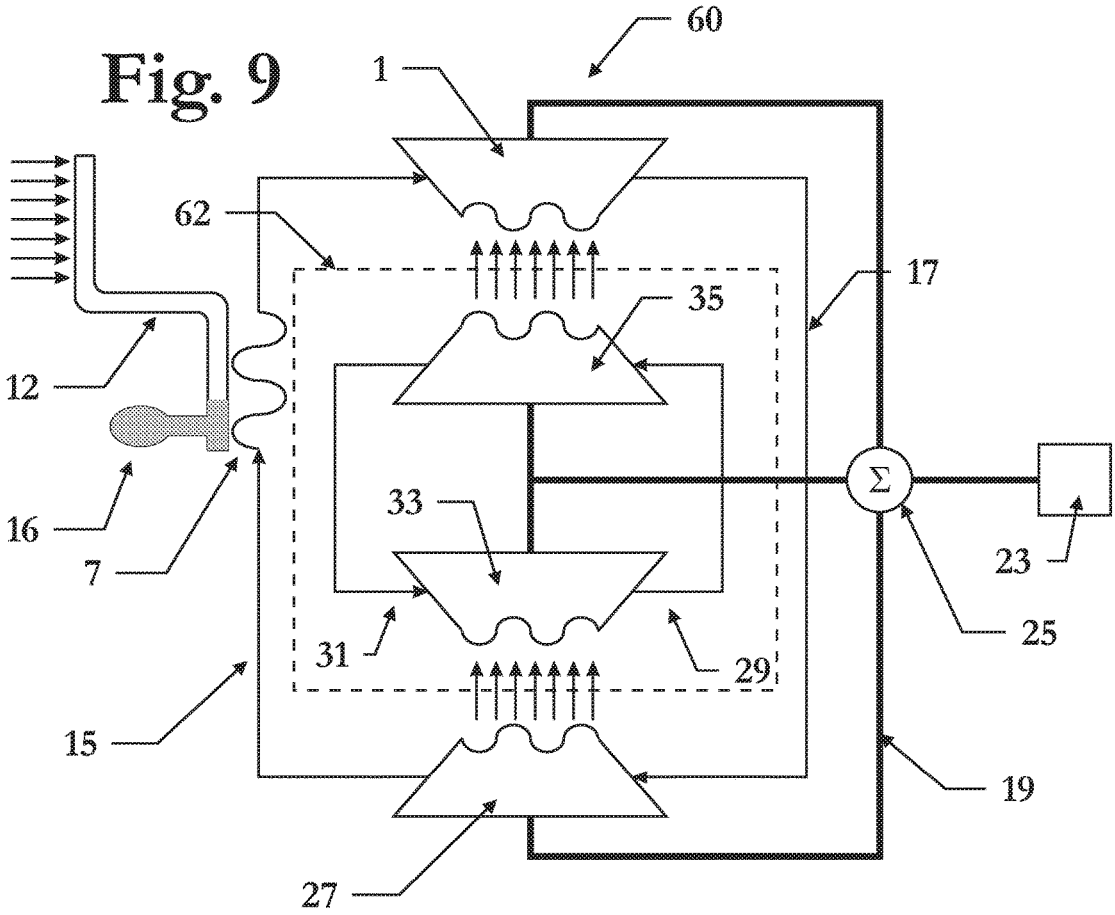
FIG. 9 is a diagram of a four-pump heat engine assembly, according to an additional preferred embodiment of the present invention.

FIG. 9 Diagram of Four-Pump System

FIG. 9 shows an embodiment of a heat engine 60 which differs from the embodiment of FIG. 8 in that the vapor-compression cycle heat pump 10 is replaced by a heat pump 62 utilizing thermally conductive pumps 35 and 33.

In this embodiment, the heat pump fluid medium undergoes its liquid to vapor phase change in thermally conductive pump 33, absorbing its latent heat of vaporization from pump 27. The heat pump fluid medium then traverses passage 29 to pump 35. Within thermally conductive pump 35, the heat pump fluid medium undergoes its vapor to liquid phase change and releases its latent heat of vaporization to pump 1 before traversing passage 31 back to pump 33 to complete the cycle. At a minimum, the use of pumps 35 and 33 helps to move the heat pump fluid medium through its cycle. Depending on the amount of latent heat absorbed from the working medium in pump 27 and absorbed by the working medium in pump 1, mechanical energy may be taken from or supplied to power transmission element 19.

Heat is conducted to heat exchanger 7 through heat pipe 12. In this embodiment, the heat pipe is a variable-conductance heat pipe which uses a variable quantity of non-condensing gas held in reservoir 16 to control the heat flow through the pipe. This is a device that will be familiar to skilled persons and may be acquired from a number of different sources. By varying the amount of non-condensing gas in the main body of the pipe, the amount of heat flow through the pipe and therefore into heat exchanger 7 can be adjusted to match the energy required by heat engine 60.

Figure 10:
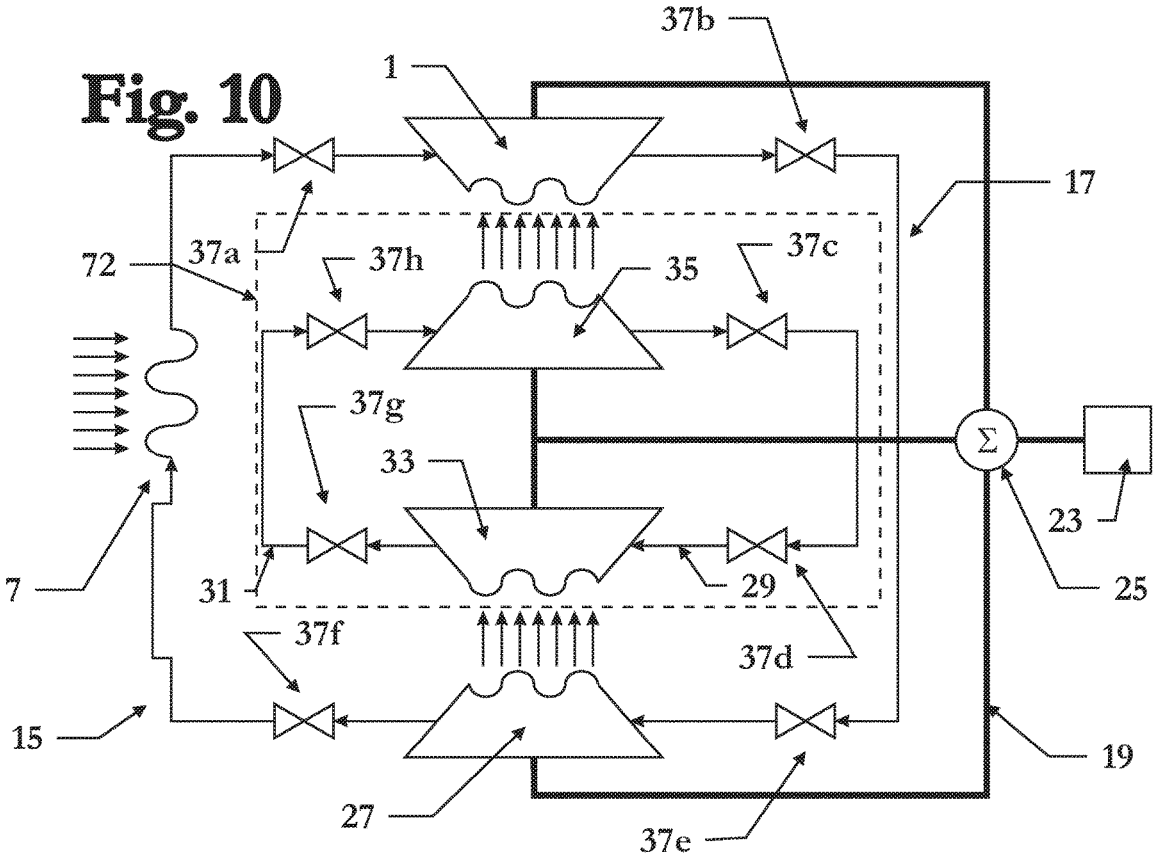
FIG. 10 is a diagram of a four-pump heat engine assembly, further including stop valves according to a preferred embodiment of the present invention.

FIG. 10 Diagram of Four-Pump System with Optional Stop Valves

FIG. 10 shows an embodiment of a heat engine which is similar to that of FIG. 9, but has a slightly modified heat pump 72, having valves 37*a-h*. Valves in any or all of these positions may be included in the embodiment, such that when closed they prevent the working medium or the heat pump medium from traversing the pump from one passage to another. These valves would be closed when the engine is not in operation, for the purpose of maintaining a pressure differential between passage 17 and passage 15, or between passages 29 and 31 while the pumps are not operating.

Figure 11:
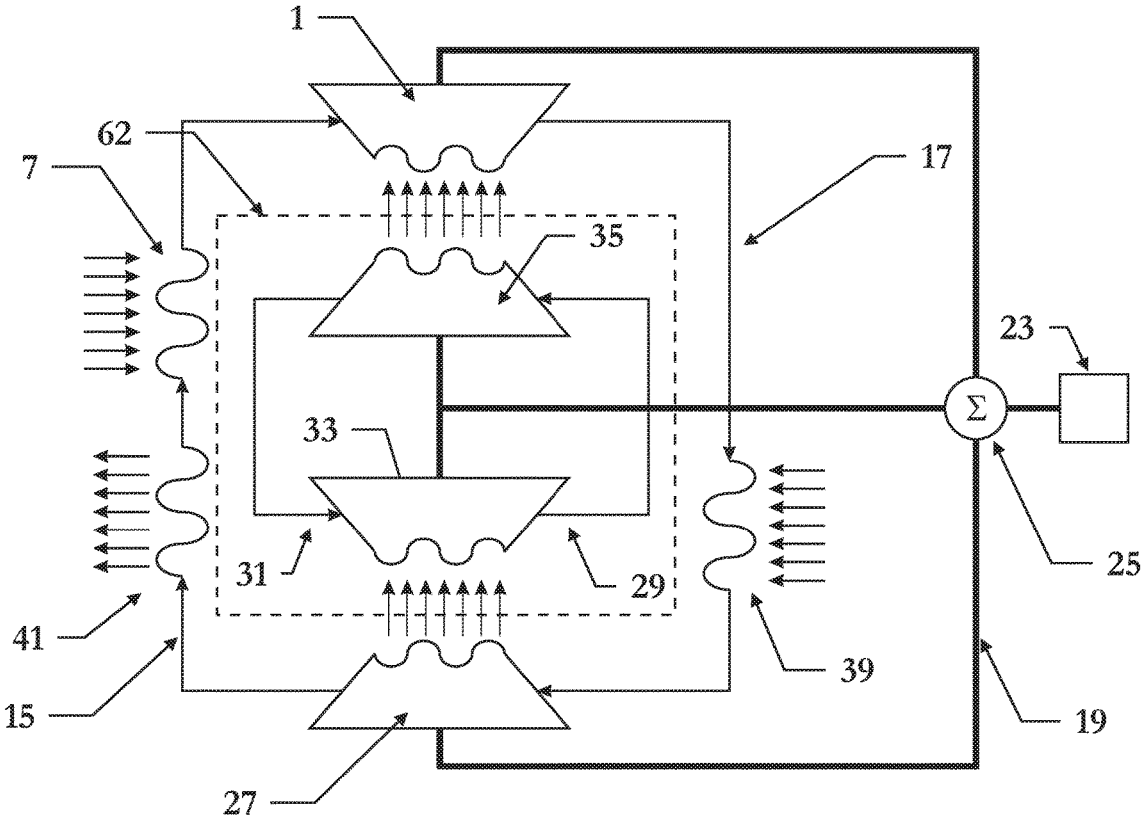
FIG. 11 is a diagram of a four-pump heat engine assembly, further including a heating element and a cooling element, according to a preferred embodiment of the present invention.

FIG. 11 Diagram of Four-Pump System with Optional Heating Element and Cooling Element FIG. 11 shows an embodiment which is similar to that of FIG. 9, having heat pump 62, but adds a heat source 39 to passage 17 and a heat sink to passage 15. Heat source 39 is intended to assist in re-starting an engine which has been shut down long enough for the working medium in passage 17 to cool down and condense, partially or in total. In that case, heat source 39 may be employed to re-vaporize the working medium in passage 17 to reduce the time required to re-start the engine. Similarly, heat sink 41 may be used to remove heat from the working medium in passage 15 in order to bring the working medium down to its operating temperature.

Figure 12:
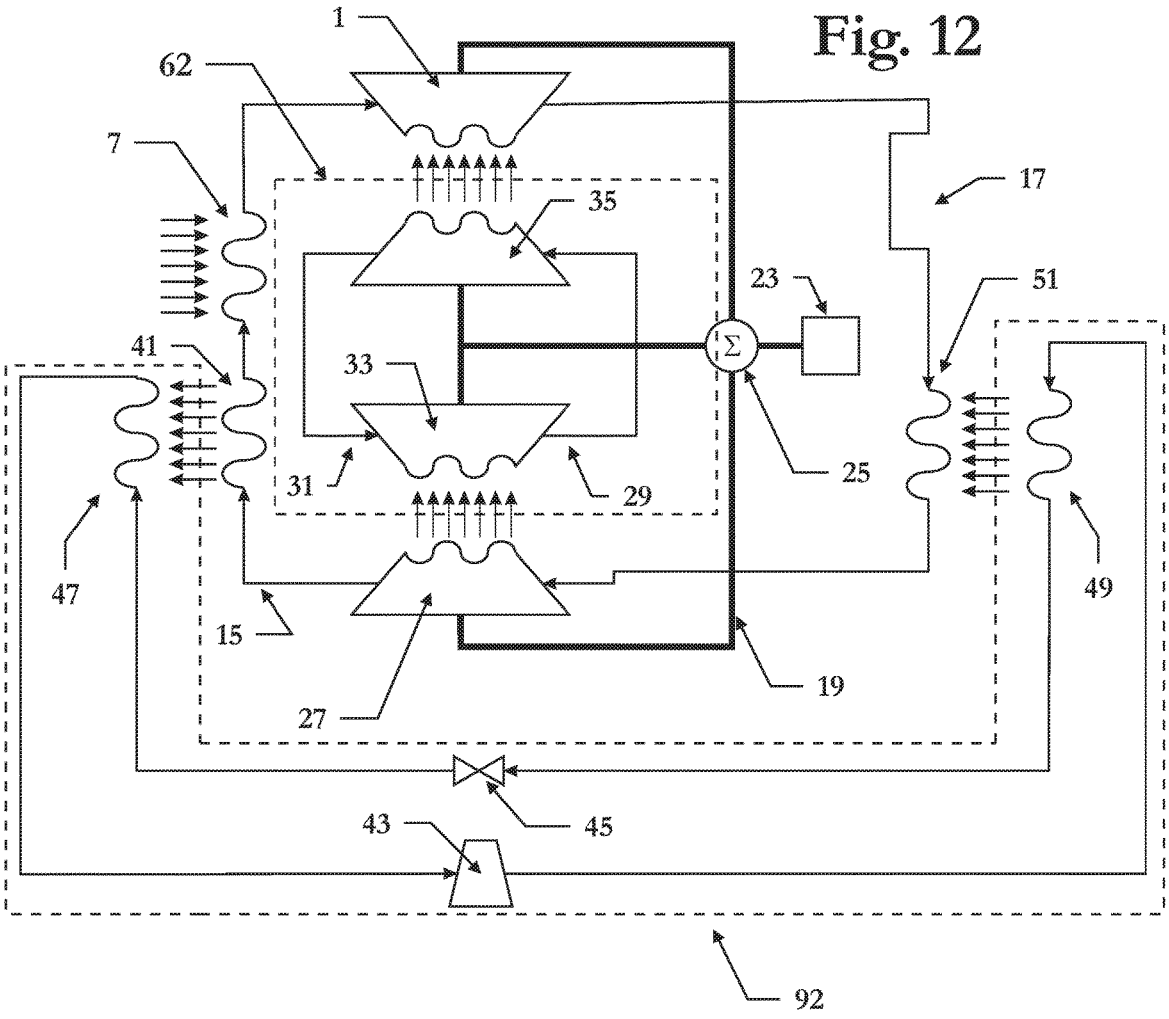
FIG. 12 is a diagram of a four-pump heat engine assembly, further including a heat pump, according to an additional preferred embodiment of the present invention.

FIG. 12 Diagram of Four-Pump System with Optional Heat Pump

The embodiment of FIG. 12 adds an additional heat pump 92 to the embodiment of FIG. 11, which removes heat from the working medium in passage 15 by way of heat exchangers 41 and 47 and supplies it to the working medium in passage 17 by way of heat exchangers 49 and 51. The heat is transferred for the purpose of reducing the time or energy required to start the engine after the working medium has approached its equilibrium temperature. The heat pump 92 in the embodiment is a vapor-compression heat pump, utilizing compressor 43 and expansion valve 45, in addition to the heat exchangers.

The heat pump may also be arranged using thermally conductive pumps, similar to the heat pump arrangement using pumps 35 and 33.

Skilled persons will readily appreciate that other permutations of inventive elements are possible, without departing from the scope of the invention.

The invention claimed is:

1. A heat-driven engine comprising:

(a) a thermally conductive pump having latent heat, to which a working medium is admitted and within which the working medium absorbs said latent heat while undergoing a phase change from a low enthalpy phase to a high enthalpy phase before being expelled from the pump;

(b) a restrictive cooling element which accepts said working medium in its high enthalpy phase and allows said working medium to release its latent heat and undergo a phase change from a high enthalpy state to a low enthalpy phase;

(c) a first passage, through which said working medium traverses between said thermally conductive pump and said restrictive cooling element;

(d) a second passage, through which said working medium traverses between said restrictive cooling element and said thermally conductive pump, said second passage having a heat exchanger, which places said working medium in thermal contact with a heat source or heat sink;

(e) a heat pump in thermal contact with said thermally conductive pump and said restrictive cooling element, whereby heat is removed from said restrictive cooling element and conducted to said heat pump by said heat exchanger; and (f) a power transmission element linking the thermally conductive pump to the heat pump and which powers the heat pump.

2. The engine of claim 1, wherein said thermally conductive pump is a first thermally conductive pump and said restrictive cooling element comprises a second thermally conductive pump, additionally linked to the power transmission element.

3. The engine of claim 2, wherein said second thermally conductive pump comprises a positive displacement pump.

4. The engine of claim 1, wherein said restrictive cooling element comprises an expansion valve and heat exchanger.

5. The engine of claim 1, wherein said thermally conductive pump comprises a positive displacement pump.

6. The engine of claim 1, wherein said heat pump comprises a vapor compression heat pump, driven by said power transmission element.

7. The engine of claim 1, wherein said heat pump comprises an absorption heat pump, driven by said power transmission element.

8. The engine of claim 1, wherein said heat pump comprises a peltier effect heat pump, and said power transmission element is an electric energy transmission element.

9. The engine of claim 1, wherein said power transmission element drives an external load.

10. The engine of claim 1, wherein said power transmission element is driven by an external power source.

11. The engine of claim 2, wherein said heat pump further includes:

(a) a third thermally conductive pump, placed in thermal contact with said thermally conductive pump;

(b) a fourth thermally conductive pump, placed in thermal contact with said restrictive cooling element;

(c) a third passage, through which a heat pump medium traverses from the third thermally conductive pump to the fourth thermally conductive pump;

(d) a fourth passage, through which a heat pump fluid medium traverses from the fourth thermally conductive pump to the third thermally conductive pump; and (e) a connection between said power transmission element and said third and fourth thermally conductive pumps, such that the heat pump is driven by said power transmission element.

12. The engine of claim 11, wherein said third thermally conductive pump comprises a positive displacement pump.

13. The engine of claim 11, wherein said fourth thermally conductive pump comprises a positive displacement pump.

14. The engine of claim 11, wherein said third thermally conductive pump is comprised of multiple pumps, linked by said power transmission element, and all communicating with said first and second passages.

15. The engine of claim 1, wherein said heat exchanger further comprises a component of restricted thermal conductivity, for the purpose of properly regulating the thermal energy conducted to said working medium.

16. The engine of claim 1, wherein said heat exchanger further comprises a component of variable thermal conductivity, for the purpose of properly regulating the thermal energy conducted to said working medium.

17. The engine of claim 16, wherein said component of variable thermal conductivity comprises a variable-conductance heat pipe.

18. The engine of claim 1, further comprising one or more valves which, in the closed state, prevent the working medium from flowing between said first passage and said second passage through said thermally conductive pump.

19. The engine of claim 2, further comprising one or more valves which, in the closed state, prevent the working medium from flowing between said first passage and said second passage through said second thermally conductive pump.

20. The engine of claim 11, further comprising one or more valves which, in the closed state, prevent the working medium from flowing between said first passage and said second passage through said third thermally conductive pump.

21. The engine of claim 11, further comprising one or more valves which, in the closed state, prevent the working medium from flowing between said first passage and said second passage through said fourth thermally conductive pump.

22. The engine of claim 1, further comprising a heat source in thermal contact with said first passage, for the purpose of bringing said working medium up to its operating temperature during a startup procedure.

23. The engine of claim 1, further comprising a heat sink in thermal contact with said second passage, for the purpose of bringing said working medium down to its operating temperature during a startup procedure.

24. The engine of claim 1, further comprising a second heat pump in thermal contact with said first passage and said second passage, for the purpose of bringing the working media contained in said passages to their correct operating temperatures during a startup procedure.

25. The engine of claim 1, further comprising additional element sets, each said additional element set including a thermally conductive pump, a restrictive cooling element, a first passage, a second passage, and a heat exchanger; all of said sets driving or being driven by said power transmission element.

26. The engine of claim 1, further comprising additional heat pumps, all of said heat pumps driving or being driven by said power transmission element.

* * * * *